United States Patent [19]

Hays

[11] Patent Number: 4,876,575

[45] Date of Patent: Oct. 24, 1989

[54] PRINTING APPARATUS INCLUDING APPARATUS AND METHOD FOR CHARGING AND METERING TONER PARTICLES

[75] Inventor: Dan A. Hays, Fairport, N.Y.

[73] Assignee: Xerox Corporation, Stamford, Conn.

[21] Appl. No.: 200,328

[22] Filed: May 31, 1988

[51] Int. Cl.[4] ..... G03G 15/08

[52] U.S. Cl. ..... 355/259; 118/653

[58] Field of Search ..... 355/3 DD, 14 D, 3 R; 118/651, 654, 647, 661, 649, 652, 653, 656, 657, 658

[56] References Cited

U.S. PATENT DOCUMENTS

| | | | |
|---|---|---|---|
| 2,846,333 | 8/1958 | Wilson | 117/17.5 |
| 3,143,438 | 8/1964 | Campbell | 118/104 |
| 3,245,377 | 4/1966 | Gettel | 118/119 |
| 4,382,420 | 5/1983 | Ohnuma et al. | 118/651 |
| 4,406,535 | 9/1983 | Sakamoto et al. | 355/3 DD |
| 4,406,536 | 9/1983 | Suzuki et al. | 355/3 DD |
| 4,459,009 | 7/1984 | Hays et al. | 355/3 DD |
| 4,464,041 | 8/1984 | Haneda et al. | 355/3 DD |
| 4,505,573 | 3/1985 | Brewington | 118/651 X |
| 4,508,052 | 4/1985 | Kohyama | 118/651 |

*Primary Examiner*—R. L. Moses

[57] ABSTRACT

The present invention relates to a development apparatus including structure for the dynamic toner metering and charging of nonmagnetic single component toner. To this end there is provided a flexible, rotating rod having an electrical bias applied thereto. The rod is captured or supported by a distributed bearing attached to a compliant blade. A toner cleaning blade held against the rod serves as a toner seal. The flexible rod is supported in a self-spaced relationship to a rigid donor roll which transports the charged toner to a development zone intermediate the donor roll and an imaging member. Self-spacing is provided by a layer of toner on the donor structure.

The donor roll and flexible rod form a toner metering and charging zone through which toner is moved to simultaneously charge and meter the toner particles. The roll and flexible rod are rotated in opposite directions for controlling the metering and charging of the toner in the nip.

29 Claims, 3 Drawing Sheets

PRINTING APPARATUS INCLUDING APPARATUS AND METHOD FOR CHARGING AND METERING TONER PARTICLES

BACKGROUND OF THE INVENTION

This invention relates generally to the rendering of latent electrostatic images visible and, more particularly, to a developer apparatus including a toner metering and charging structure.

The invention can be utilized in the art of xerography or in the printing arts. In the practice of conventional xerography, it is the general procedure to form electrostatic latent images on a xerographic surface by first uniformly charging a photoconductive insulating surface or photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction. The developed image is then fixed to the imaging surface or is transferred to a receiving substrate such as plain paper to which it is fixed by suitable fusing techniques.

The development of images by various methods, including electrostatographic means is well known. In some of these systems, toner particles are deposited on an electrostatic latent image contained on an insulating surface, such as selenium, utilizing, for example, cascade development, magnetic brush development, powder cloud development, touchdown development, and the like.

In view of some of the disadvantages of two component systems, there has been considerable effort directed to designing systems which utilize only toner particles, for example, U.S. Pat. No. 2,846,333, which discloses a single component developer composition that is comprised of toner resins, colorants and magnetic materials. Many of the single component development systems contain conductive toner particles, whereby imagewise toner deposition onto the imaging member is obtained by induction charging of the toner particles. Electrostatic transfer of conductive toner particles to plain bond paper is, however, usually inefficient as the charge on the toner particles can be reversed by induction charging from the paper during the transfer step. Accordingly, electrophotographic systems wherein conductive single component toner particles are used require an alternative transfer method and materials such as a special overcoated insulating paper to achieve sufficient toner transfer. Furthermore, in single component systems with conductive toner particles, the control of undersirable background or background suppression cannot usually be achieved with electrostatic forces alone, as the toner particles are inductively charged and deposited on the imaging bearing member in both the image and background areas, which is not the situation in two component developer systems where suppression of background development is accomplished by electrostatic forces acting on the triboelectrically charged toner particles, causing such particles to be directed away from image bearing member.

Recent developments in the area of single component development has resulted in an efficient, economical, simple process and apparatus wherein insulative, nonmagnetic, toner particles are appropriately charged and there is obtained two component image quality utilizing a single component development apparatus. In this system, as described in U.S. Pat. No. 4,505,573 issued on Mar. 19, 1985, the disclosure of which is totally incorporated herein by reference, a charging roll means simultaneously meters and charges toner particles. A donor electrode roll serves to transport the toner particles, which electrode can be comprised of numerous suitable materials including for example a conducting roll overcoated with a polymer containing carbon black.

Heretofore, one of the aforementioned rolls (i.e. charging roll or donor electrode roll) was fabricated so that it was compliant to accommodate the runout of the other roll which was rigid. Such compliant roll structures usually consisted of a thin metal, for example, an electroformed nickel, sleeve mounted on a foam core. Although such a structure is functional for its intended purpose, several disadvantages have been noted including difficulty of manufacture, susceptibility to damage, foam set and sealing reliability.

Certain patents which may be relevant to the present invention will now be discussed.

U.S. Pat. No. 3,143,438 issued on Aug. 4, 1964 relates to apparatus for coating web material. Disclosed therein is a metering and smoothing device comprising a cylindrical rod which is mounted between a flexible doctor blade and a rod holder or receiving member.

U.S. Pat. No. 3,245,377 issued on Apr. 20, 1962 relates to an apparatus for coating paper. Disclosed is a cylindrical rod which extends lengthwise of a resilient backing roll and is retained in a socket by spring pressure exerted by a spring clip.

U.S. Pat. No. 4,382,420 issued on May 10, 1983 relates to an apparatus for developing a latent electrostatic image formed on a photoconductive recording material in a dry type electrophotographic copying machine typically employing a one component type developer with a conductive electrode held in contact with the developer. The electrode is connected to a power source through a switching device and serves to charge the developer to a predetermined polarity with a predetermined potential before the latent image is developed. In this way, the latent image can be developed selectively as either a normal image or a reverse image quite easily. FIG. 6 thereof discloses a charge and metering roller which regulates the layer of toner on a development belt and serves as an electrode as well.

U.S. Pat. No. 4,459,009 issued on July 10, 1984 relates to a process and apparatus for charging insulating toner particles wherein there is provided a charging roll containing a triboelectrically active coating, and weakly charged toner particles are transported into contact with the coating contained on the charging roll, this contact being accomplished in a charging zone situated between the charging roll and the transporting mechanism. As a result of contact between the weakly charged toner particles and the triboelectrically active coating contained on the charging roll there is imparted charges of either a positive or negative polarity to the weakly charged toner particles. The apparatus and process of the present invention are useful, for example, in electrostatographic recording imaging devices.

U.S. Pat. No. 4,464,041 issued on Aug. 7, 1984 relates to developing apparatus for producing an electrostatic latent image on a charge retaining member such as a drum, a rotating member for producing a shifting magnetic field is used to transport magnetic toner on a stationary sleeve from a toner source to a developing area on the drum. The amount of toner so transported is regulated by a magnetizable member positioned adjacent the rotating member before the developing area, the magnetizable member being characterized by a curved surface on which a shifting magnetic field is induced by the said rotating member and which attracts excess toner from the latter.

U.S. Pat. No. 4,505,573 issued on Mar. 19, 1985 relates to an apparatus for effecting the charging of insulating toner on a moving roller, and a toner transporting roller or belt with a coating thereover comprised of a mixture of conductive particulate particles, such as carbon black. The coating may be textured with silica particles. Useful polymers selected for the coating include fluorinated ethylene-propylene and polytetrafluorothylene copolymers.

U.S. patent application Ser. No. 171,062 filed on or about Mar. 21, 1988 and assigned to the same assignee as the instant invention discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

BRIEF SUMMARY OF THE INVENTION

Briefly, the present invention relates to a development apparatus including structure for the dynamic toner metering and charging of non-magnetic single component toner. To this end there is provided a flexible, rotating rod having an electrical bias applied thereto. The rod is captured or supported by a distributed bearing attached to a compliant blade. A toner cleaning blade held against the rod serves as a toner seal. The flexible rod is supported in a self-spaced relationship to a rigid donor roll which transports the charged toner to a development zone intermediate the donor roll and an imaging member. Self-spacing is provided by a layer of toner on the donor structure.

The donor roll and flexible rod form a toner metering and charging zone through which toner is moved to simultaneously charge and meter the toner particles. The roll and flexible rod are rotated in opposite directions for controlling the metering and charging of the toner in the nip.

DETAILED DESCRIPTION OF THE PREFERRED EMBODIMENT OF THE INVENTION

While the present invention can be utilized in conventional xerography and analogous printing arts it can also be utilized in highlight color imaging and will be disclosed in connection with such an imaging system and, in particular, it will be incorporated in a tri-level, highlight color imaging system.

Figure 1A:
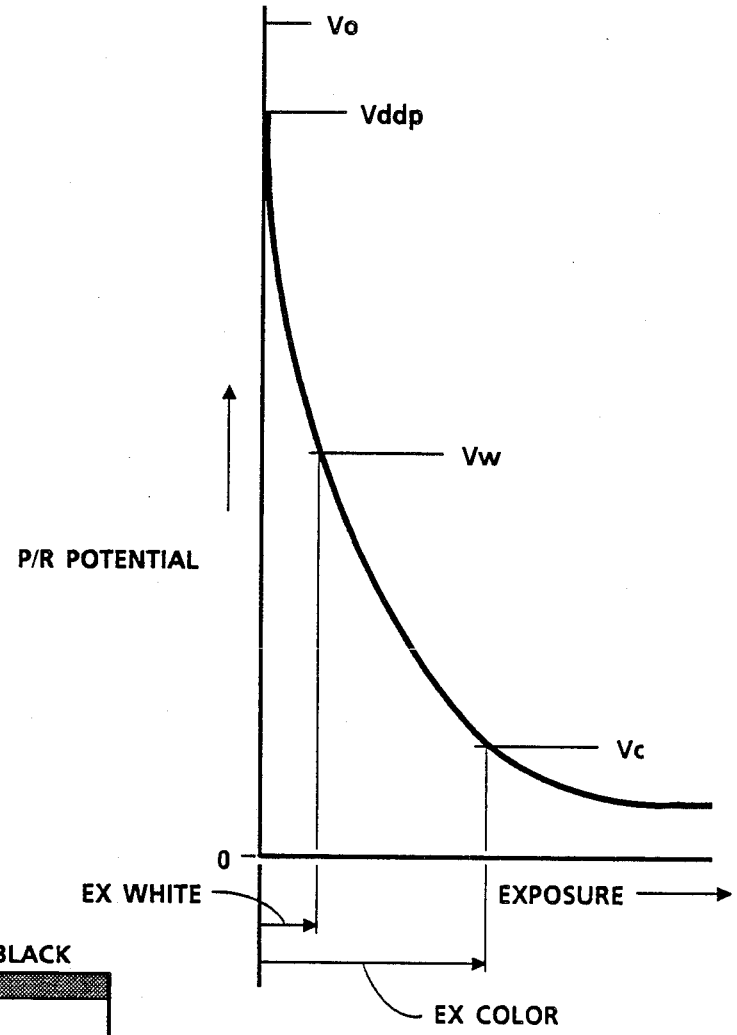
FIG. 1*a* is a plot of photoreceptor potential versus exposure illustrating a tri-level electrostatic latent image.
Figure 1B:
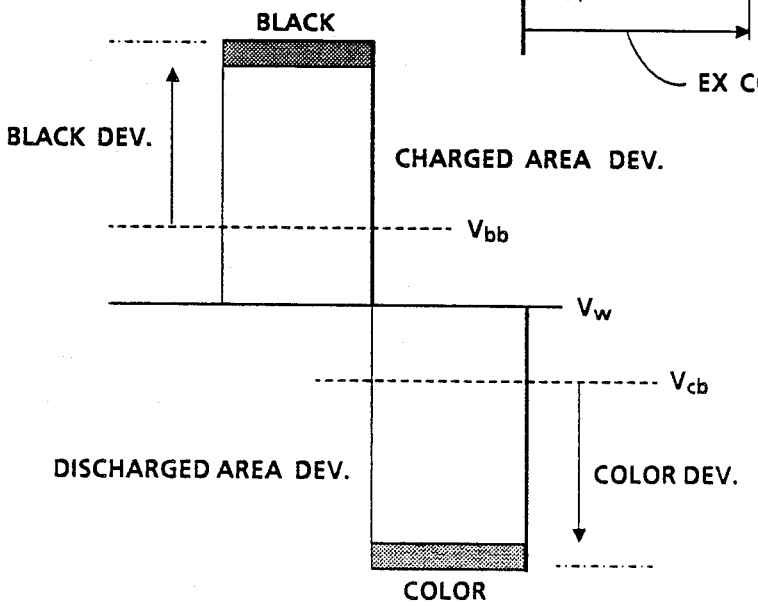
FIG. 1*b* is a plot of photoreceptor potential illustrating single-pass, highlight color latent image characteristics.

For a better understanding of the concept of tri-level, highlight color imaging, a description thereof will now be made with reference to FIGS. 1*a* and 1*b*. FIG. 1*a* illustrates the tri-level electrostatic latent image in more detail. Here $V_0$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved when passing the photoreceptor through two developer housings in tandem or in a single pass by electrically biasing the housings to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electrostatic field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electrostatic field existing between the photoreceptor and the development rolls in the first housing at bias voltage $V_{cb}$ (V color bias).

Figure 2:
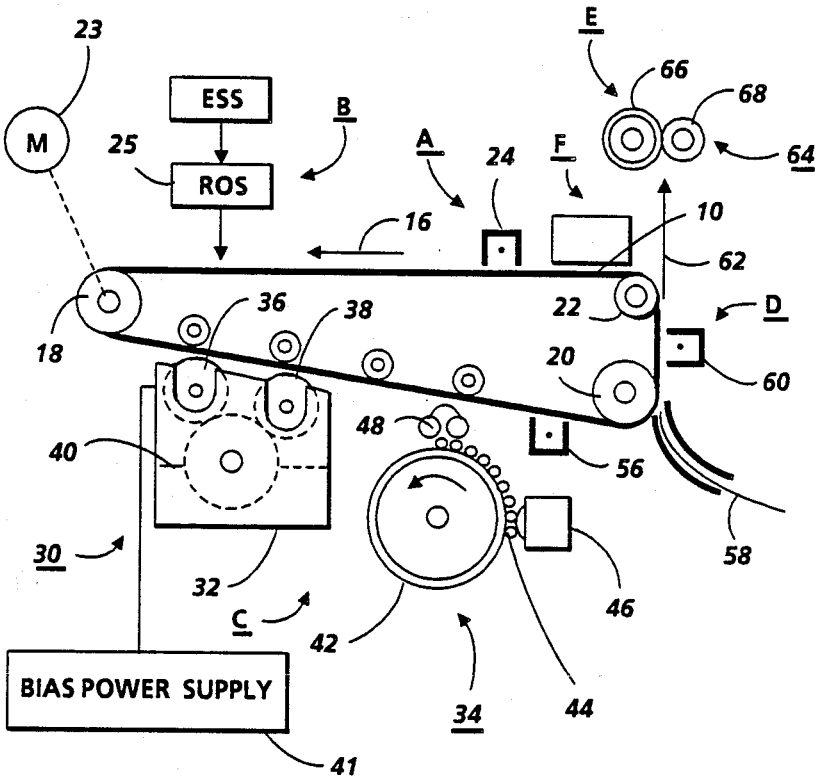
FIG. 2 is schematic illustration of a printing apparatus incorporating the inventive features of our invention.

As shown in FIG. 2, a printing machine incorporating the present invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about 900 volts. When exposed at the exposure station B it is discharged to $V_c$ equal to about 100 volts which is near zero or ground potential in the highlight (i.e. color other than black) color parts of the image. See FIG. 1*a*. The photoreceptor is also discharged to $V_w$ equal to 500 volts imagewise in the background (white) image areas.

At development station C, a development system, indicated generally by the reference numeral 30 advances single component developer materials into contact with the electrostatic latent images. The development system 30 comprises first and second developer apparatuses 32 and 34. The developer apparatus 32 comprises a housing 34 containing a pair of magnetic brush rollers 36 and 38. The rollers advance developer material 40 into contact with the latent images on the charge retentive surface which are at the voltage level $V_c$. The developer material 40 by way of example comprises red toner. Appropriate electrical biasing is accomplished via power supply 41 electrically connected to developer apparatus 32. A DC bias of approximately 400 volts is applied to the rollers 36 and 38 via the power supply 41.

The developer apparatus 34 comprises a donor structure in the form of a rigid roller 42. The donor structure 42 conveys nonmagnetic single component developer or toner 44 deposited thereon via a combination metering and charging device 46 (FIG. 3) to a position opposite an electrode structure. The developer in this case comprises black toner. The donor structure can be rotated in either the 'with' or 'against' direction vis-a-vis the direction of motion of the charge retentive surface. The donor roller 42 is preferably coated with TEFLON-S (trademark of E.I. du Pont de Nemours).

The developer apparatus further comprises an electrode structure 48 which is disposed in the space between the charge retentive surface 10 and the donor structure 42. The electrode structure comprises a plurality of thin (i.e. 50 to 100$\mu$ diameter) tungsten wires which are closely positioned relative to the donor structure 42. The distance between the wires and the donor is approximately 25$\mu$ or the diameter of a toner particle. The wires are self-spaced from the donor structure by the thickness of the toner on the donor structure. To this end the extremities of the wires are secured to the tops of end bearing blocks (not shown) supporting the donor structure for rotation. The extremities are attached so that they are slightly below a tangent to the surface, including the toner layer, of the donor structure. Mounting the wires in such a manner makes them insensitive to roll runout.

Figure 3:
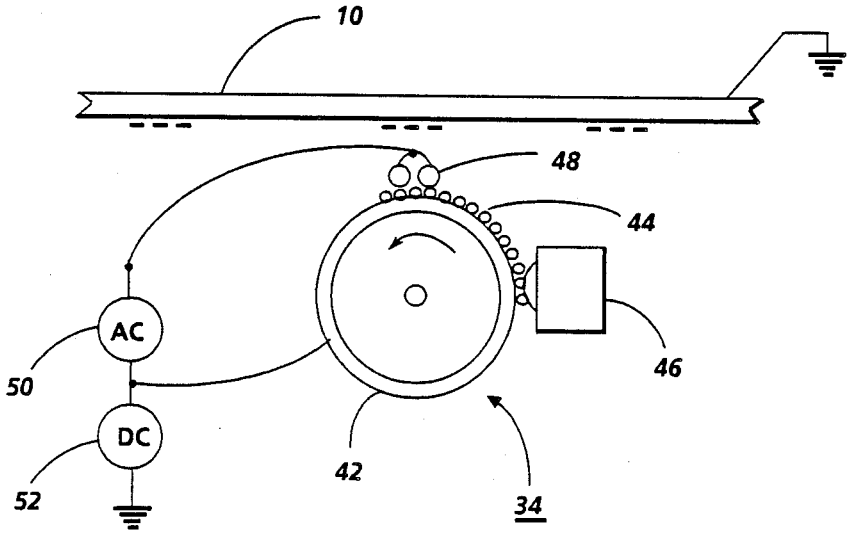
FIG. 3 is a fragmentary schematic illustration of a developer donor roll and electrical bias arrangement.

As illustrated in FIG. 3, an alternating electrical bias is applied to the electrode structure via an AC voltage source 50. The applied AC establishes an alternating electrostatic field between the wires and the donor structure which is effective to detach toner from the surface of the donor structure and form a toner cloud about the wires, the height of the cloud being such as not to contact with the charge retentive surface. The magnitude of the AC voltage is relatively low and is in the order of 200 to 300 volts peak at a frequency of about 4 kHz up to 10 kHz. A DC bias supply 52 which applies approximately 700 volts to the donor structure 42 establishes an electrostatic field between the charge retentive surface of the photoreceptor 10 and the donor structure for attracting the detached toner particles from the cloud surrounding the wires to the latent image on the charge retentive surface. At a spacing of approximately 25$\mu$ between the electrode and donor structures an applied voltage of 200 to 300 volts produces a relatively large electrostatic field without risk of air breakdown. The field strength produced is in the order of 8 to 12 volts/$\mu$. While the AC bias is illustrated as being applied to the electrode structure it could equally as well be applied to the donor structure.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 9 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 4:
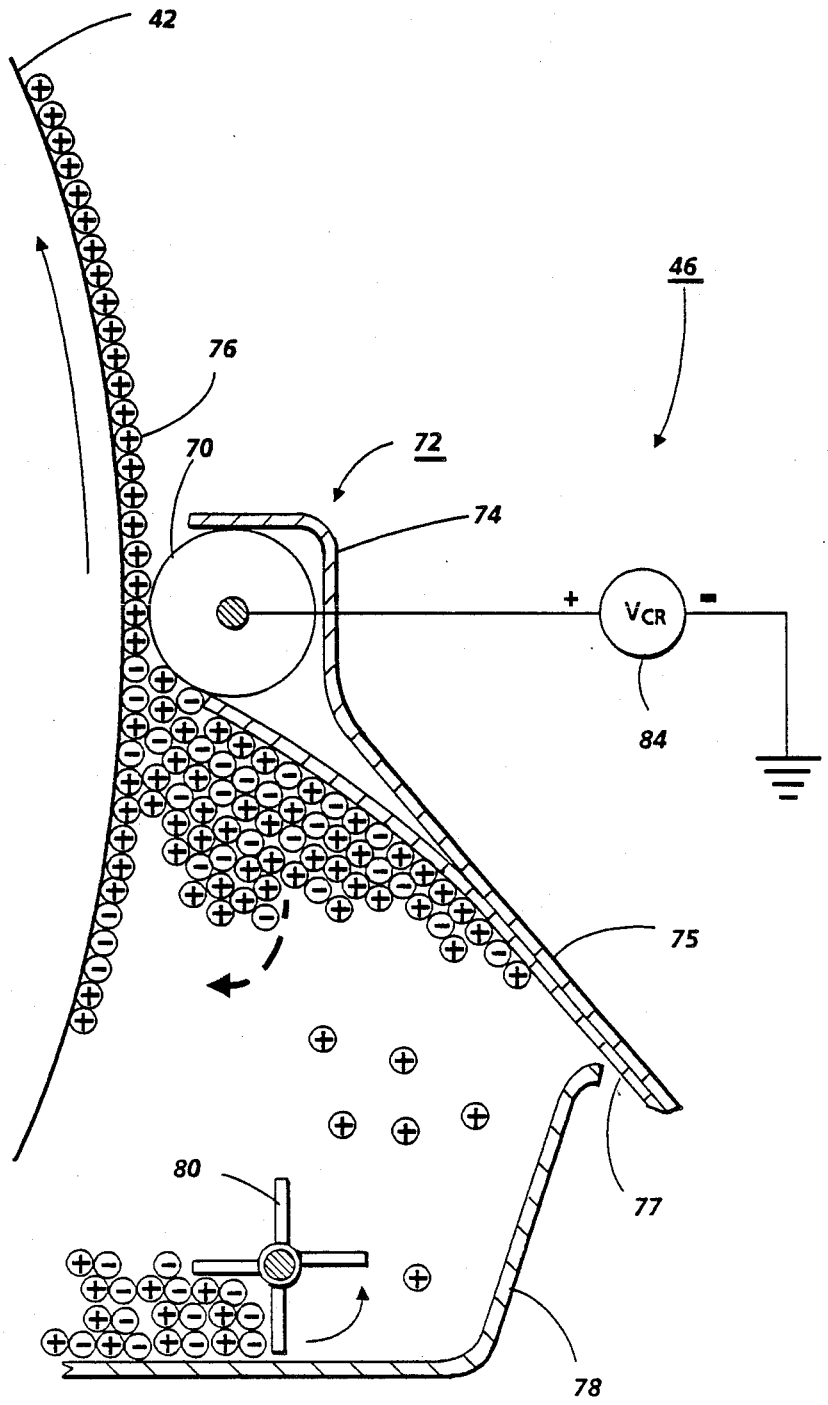
FIG. 4 is a fragmentary schematic illustration of a developer apparatus a novel toner charging and metering arrangement.

As illustrated in FIG. 4, the combination metering and charging device 46 comprises a flexible rod 70 which is preferably fabricated from anodized aluminum. The flexible rod 70 which has a diameter in the order of 0.100 to 0.125 inch is supported by a distributed bearing structure 72. Larger diameter rods may be used if fabricated from a composite structure such as metalized plastic tube or rod. The modulus for a metal rod is preferably $3\times10^7$ lb/in$^2$ compared to $3\times10^5$ lb/in$^2$ for plastic.

The bearing structure 72 comprises an L-shaped segment 74 which cooperates with the donor and toner layer thereon to captivate the flexible rod along its entire axial extent. The bearing structure 74 also comprises an elongated, compliant arm 75 by which the bearing structure is mounted to a frame member (not shown). The bearing structure is mounted in cantilever fashion such that the flexible rod is self-spaced relative to the donor roll 42 by a thin layer of toner particles 76. A cleaning blade 77 for removing toner particles from the rod is carried by the compliant arm 75. The edge of the foot of the L-shaped segment is crenellated to thereby render the foot flexible. The L-shaped portion comprising the supporting structure for the rod may be fabricated from metal or plastic.

Randomly charged as well as non-charged toner particles are contained in a hopper supply 78 and are moved, through the action of a paddle wheel 80 to a toner metering and charging zone 82 intermediate the donor roll and the flexible rod. The rod is rotated by a motor M in a direction opposite the direction of rotation of the donor roll structure. The flexible rod is electrically biased at a DC bias 84 with the same polarity as the toner charge. This ensures that the (positive) toner particles of desired charge are not attracted away from the donor structure to the flexible rod and that the toner particles of undesired charge of opposite polarity are attracted to the flexible rod and removed from the metering and charging zone 82.

It should now be appreciated that there has been described a toner metering and charging device for presenting charged toner particles to a donor structure which device is insensitive to roll runout of the donor. Thus, the conformability of such arrangements found in the prior art which depend upon a deformable roll is replaced by a flexible rod which produces the required function without being difficult to manufacture and susceptible to damage and subject to foam set and sealing reliability.

What is claimed is:

1. Apparatus for developing latent electrostatic images on a charge retentive surface with toner, said apparatus comprising:

a supply of toner;

a donor structure supported for movement in an endless path for conveying toner from said supply of toner to an area opposite said charge retentive surface;

means including a flexible rod, supported in contact with toner on said donor structure and disposed between it and said donor structure, for effecting metering and charging of said toner without being adversely affected by runout of said donor structure.

2. Apparatus according to claim 1 wherein said donor structure comprises a rigid roll.

3. Apparatus according to claim 2 wherein said flexible rod has a relatively small diameter.

4. Apparatus according to claim 3 wherein the diameter of said flexible rod is in the order of 0.100 to 0.125 inch.

5. Apparatus according to claim 4 wherein said flexible rod is fabricated from metal.

6. Apparatus according to claim 4 wherein said flexible rod is fabricated from metalized plastic.

7. Apparatus according to claim 1 including a distributed bearing for operatively supporting said flexible rod.

8. Apparatus according to claim 7 wherein said bearing structure comprises an L-shaped segment and the foot thereof is crenellated.

9. Apparatus according to claim 8 including a cleaning blade carried by said bearing structure and contacting said flexible rod.

10. Apparatus according to claim 9 including means for applying an electrical bias to said flexible rod.

11. Apparatus according to claim 10 wherein said donor structure is spaced a small distance from said charge retentive surface.

12. Apparatus according to claim 11 including means for applying an electrical bias to said donor structure.

13. Apparatus according to claim 1 wherein said flexible rod is rotatable.

14. Apparatus according to claim 13 wherein said donor structure is a non-magnet member member.

15. Apparatus according to claim 1 wherein said donor structure is a non-magnetic member.

16. Printing apparatus including means for forming latent electrostatic images on a charge retentive surface and rendering them visible with toner particles, said apparatus comprising:

means for forming latent images on said charge retentive surface;

means for rendering said latent images visible including:

a supply of toner;

a donor structure supported for movement in an endless path for conveying toner from said supply of toner to an area opposite said charge retentive surface; and means including a flexible rod, supported in contact with toner on said donor structure and disposed between it and said donor structure, for effecting metering and charging of said toner without being adversely affected by runout of said donor structure.

17. Apparatus according to claim 16 wherein said donor structure comprises a rigid roll.

18. Apparatus according to claim 17 wherein said flexible rod has a relatively small diameter.

19. Apparatus according to claim 18 wherein the diameter of said flexible rod is in the order of 0.100 to 0.125 inch.

20. Apparatus according to claim 19 wherein said flexible rod is fabricated from metal.

21. Apparatus according to claim 19 wherein said flexible rod is fabricated from metalized plastic.

22. Apparatus according to claim 16 including a distributed bearing for operatively supporting said flexible rod.

23. Apparatus according to claim 22 wherein said bearing structure comprises an L-shaped segment and the foot thereof is crenellated.

24. Apparatus according to claim 23 including a cleaning blade carried by said bearing structure and contacting said flexible rod.

25. Apparatus according to claim 24 including means for applying an electrical bias to said flexible rod.

26. Apparatus according to claim 25 wherein said donor structure is spaced a small distance from said charge retentive surface.

27. Apparatus according to claim 26 including means for applying an electrical bias to said donor structure.

28. Apparatus according to claim 16 wherein said donor structure is a non-magnet member member.

29. Printing apparatus including means for forming latent electrostatic images on a charge retentive surface and rendering them visible with toner particles, said apparatus comprising:

means for forming latent images on said charge retentive surface;

means for rendering said latent images visible including:

a supply of toner;

a donor structure supported for movement in an endless path for conveying toner from said supply of toner to an area opposite said charge retentive surface;

means disposed intermediate said donor structure and said charge retentive surface for effecting detachment of toner from the surface of said donor structure and causing it to contact the charge retentive surface; and means including a flexible rod, supported in contact with toner on said donor structure and disposed between it and said donor structure, for effecting metering and charging of said toner without being adversely affected by runout of said donor structure.

* * * * *